United States Patent [19]

Zeidler et al.

[11] 4,047,843

[45] Sept. 13, 1977

[54] CENTRIFUGAL IMPELLER FOR SANDBLASTING INSTALLATIONS

[75] Inventors: Johannes Zeidler, Reinbek; Bernd Von Borcke, Bad Oldesloe, both of Germany

[73] Assignee: Alfred Gutmann Gesellschaft fur Maschinenbau, Hamburg, Germany

[21] Appl. No.: 695,063

[22] Filed: June 11, 1976

[30] Foreign Application Priority Data

Feb. 16, 1976 Germany ..... 2606063

[51] Int. Cl.[2] ..... F04D 29/24

[52] U.S. Cl. ..... 416/185; 416/221

[58] Field of Search ..... 416/185, 186, 186 A, 416/221

[56] References Cited

U.S. PATENT DOCUMENTS

| | | | |
|---|---|---|---|
| 1,535,417 | 4/1925 | Huff | 416/185 |
| 2,224,664 | 12/1940 | Bierend | 416/185 |
| 2,745,597 | 5/1956 | Sinclair et al. | 416/185 |
| 2,828,942 | 4/1958 | McCullough et al. | 416/221 |
| 2,847,187 | 8/1958 | Murphy | 416/221 |
| 2,848,190 | 8/1958 | Barr | 416/185 |
| 2,928,651 | 3/1960 | Turnbull | 416/221 |

FOREIGN PATENT DOCUMENTS

| | | | |
|---|---|---|---|
| 299,672 | 5/1971 | U.S.S.R. | 416/186 A |

*Primary Examiner*—Everette A. Powell, Jr.
*Attorney, Agent, or Firm*—Olsen and Stephenson

[57] ABSTRACT

A centrifugal impeller of the so-called single-disc wheel type wherein the projector blades are mounted by dovetail joints to the impeller wheel and locked in position by releasable entirely encapsulated leaf springs inserted into recesses between the impeller wheel and an associated projector blade.

4 Claims, 3 Drawing Figures

CENTRIFUGAL IMPELLER FOR SANDBLASTING INSTALLATIONS

BACKGROUND OF THE INVENTION

The present invention relates to a centrifugal impeller for sandblasting installations, including a rotatively driven centrifugal impeller wheel and a plurality of radially oriented projecting blades mounted on one side surface of the impeller wheel by associated dovetail joints and locked in position by respective spring members.

In heretofore known centrifugal impellers of the above-indicated type which may be termed so-called "single-disc" wheels, a plurality of projecting blades are mounted on only one side surface of the impeller wheel. Each mounting assembly for a projecting blade includes a dovetail joint, and the projecting blade is locked in position by a thrust bolt extending through a threaded bore in the centrifugal impeller wheel and tightened against the dovetail key of the projecting blade. Each thrust bolt includes a hexagonal recess for tightening and releasing respectively the bolt. This recess must be protected against the blasting medium by inserting an additional plug member. The inner end of the thrust bolt must be provided with a cylindrical end portion, and the dovetail key of the projecting blade must be provided with a corresponding recess for receiving the inner end of the bolt and locking the projecting blade in position. This type of mounting is rather complicated and relatively expensive. In case of improper handling it may become very difficult to release the bolts.

In so-called two-disc wheels it has already been suggested to employ springs for mounting and locking the projecting blades. With such an arrangement, these springs are freely exposed on one side of the projecting blades, with the result that centrifugal impellers of this type may only be used in one direction of rotation. An operation in the opposite direction of rotation is not possible since the side surfaces at which are arranged the unprotected springs may not be exposed to the blasting medium.

SUMMARY OF THE INVENTION

It is now an object of the present invention to provide a novel and improved centrifugal impeller for sandblasting installations.

It is another object of the present invention to provide a novel and improved impeller of the general type as stated at the outset of the present specification in which impeller the projecting blades are not mounted and secured by screws but by springs and wherein the springs are arranged so as to allow reversible, i.e. bi-directional operation of the impeller.

In accordance with the present invention, the above objects are achieved in that each spring is accommodated within a suitably shaped recess arranged in the region of a dovetail joint between a projecting blade and the centrifugal impeller wheel whereby the spring is entirely enclosed between the projecting blade and the impeller wheel.

In the centrifugal impeller of the present invention the springs are mounted in a position in which the blasting medium cannot attack the springs, no matter in which direction the centrifugal impeller is being rotated. Concurrently, the projecting blades are securely retained against movements in a radially outward direction which may be caused by centrifugal forces, and this in a simple and elegant manner by merely connecting the spring with one member so that in the completed assembly the spring engages the other of the members. For disassembling, it is merely required to relieve the spring so that the dovetail joint may be disengaged.

In a particular embodiment of the present invention, the spring is advantageously mounted in a recess in the inner face of the dovetail key on the projecting blade opposite the bottom wall of the dovetailed groove in the centrifugal impeller wheel so that upon sliding the spring in a radial inward direction into the dovetailed groove the radially outer end surface of the spring engages and edge of a recess in the centrifugal impeller wheel.

This particular embodiment represents an elegant and simple solution since the spring may be inserted together with the dovetail key of the projecting blade into the dovetailed groove, and when the projecting blade has reached its desired final position the spring automatically engages an edge of the centrifugal impeller wheel. It is not intended, however, to restrict the scope of the present invention to this particular embodiment. Alternatively, the spring may be attached to the centrifugal impeller wheel so that after connecting the projectng blade to the impeller wheel the spring engages the projecting blade.

According to another embodiment of the present invention, the centrifugal impeller wheel may include, for each projecting blade, an aperture that is accessible from the side surface of the impeller wheel opposite a projecting blade, the aperture communicating with the region in which the spring locks the projecting blade and engages a portion of the centrifugal impeller wheel. This aperture allows to introduce a suitable tool for deforming the spring so that the latter becomes disengaged and the projecting blade may be withdrawn from the centrifugal impeller wheel.

Advantageously, the aperture communicates with the recess an edge of which is engaged by the spring.

As may thus be seen, the present invention basically provides a very simple and readily manufactured releasable locking device for the projecting blades, in allowing additionally bi-directional operation of the centrifugal impeller without exposing the spring to the blasting medium.

Further advantages and the individual characteristics of the present invention will be explained more in detail in the following with reference to the appended drawings in which is illustrated one embodiment of the present invention.

DESCRIPTION OF THE PREFERRED EMBODIMENT

Figure 1:
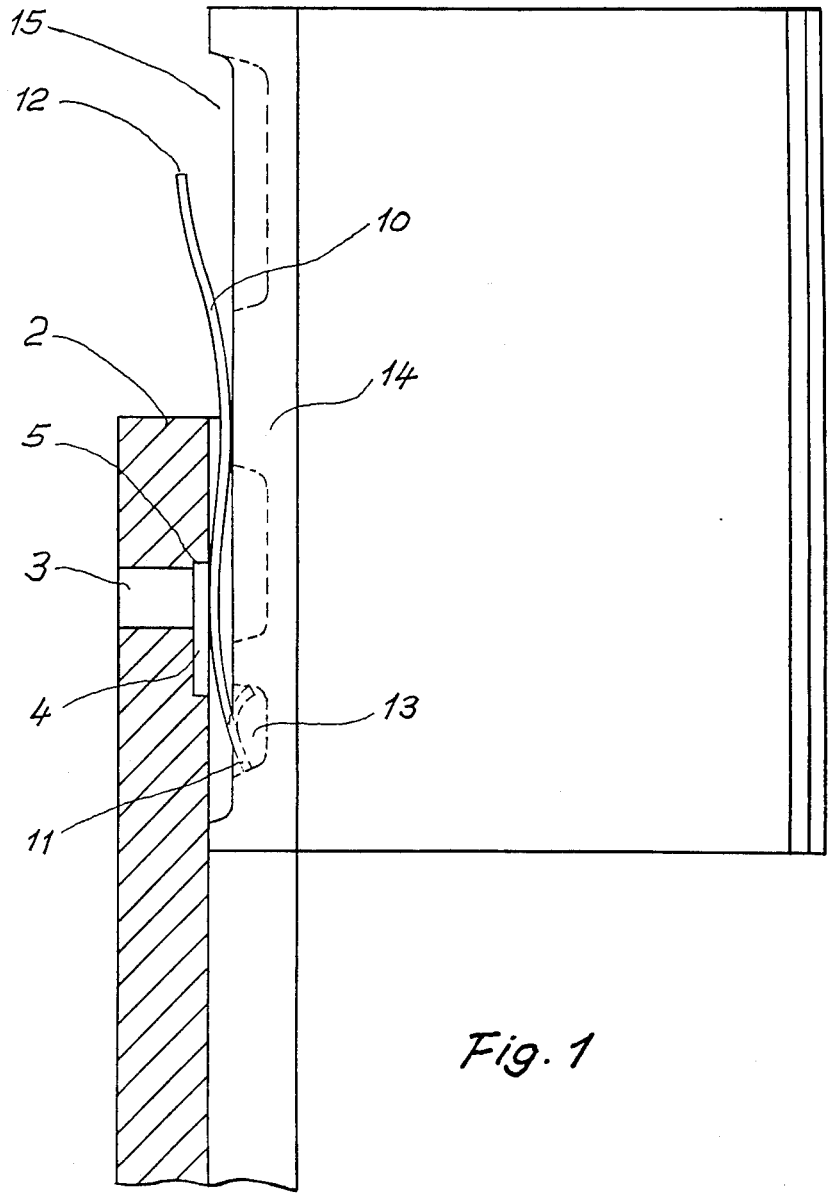
FIG. 1 is a fragmentary radial sectional view of a centrifugal impeller and a projecting blade that has been partly inserted in radial direction.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring to the drawings, the centrifugal impeller shown therein is a so-called single-disc wheel for operation in both directions of rotation. This centrifugal impeller includes a centrifugal impeller wheel 2 and a plurality of radially oriented projecting blades 1, all of which are mounted on the one side surface of the impeller wheel 2. In the drawings only one projecting blade 1 is shown and it may be understood that all of the projecting blades are mounted in a similar manner.

In one side surface of the centrifugal impeller wheel 2 are formed radially extending dovetailed grooves 7. Each dovetailed groove 7 includes a pair of inclined side walls 8 and a bottom wall 9. These dovetailed grooves 7 serve to slidingly receive the matingly shaped dovetail keys 14 of the projecting blades 1.

In the inner face of the dovetail key 14 which face is opposite the bottom wall 9 of the dovetail groove 7 is provided a recess 15. Within this recess 15 is formed a mounting recess 13, and a leaf spring 10 is retained within this mounting recess 13. Further recesses shown in dashed lines communicate with the recess 15. The spring 10 includes at its inner end 11 with respect to the impeller wheel 2 a bent hook for retaining the spring in the corresponding recess, as may best be seen in FIG. 1.

A recess 4 defining a radial outer edge 5 is formed in the bottom wall 9 of the dovetailed groove 7.

Figure 2:
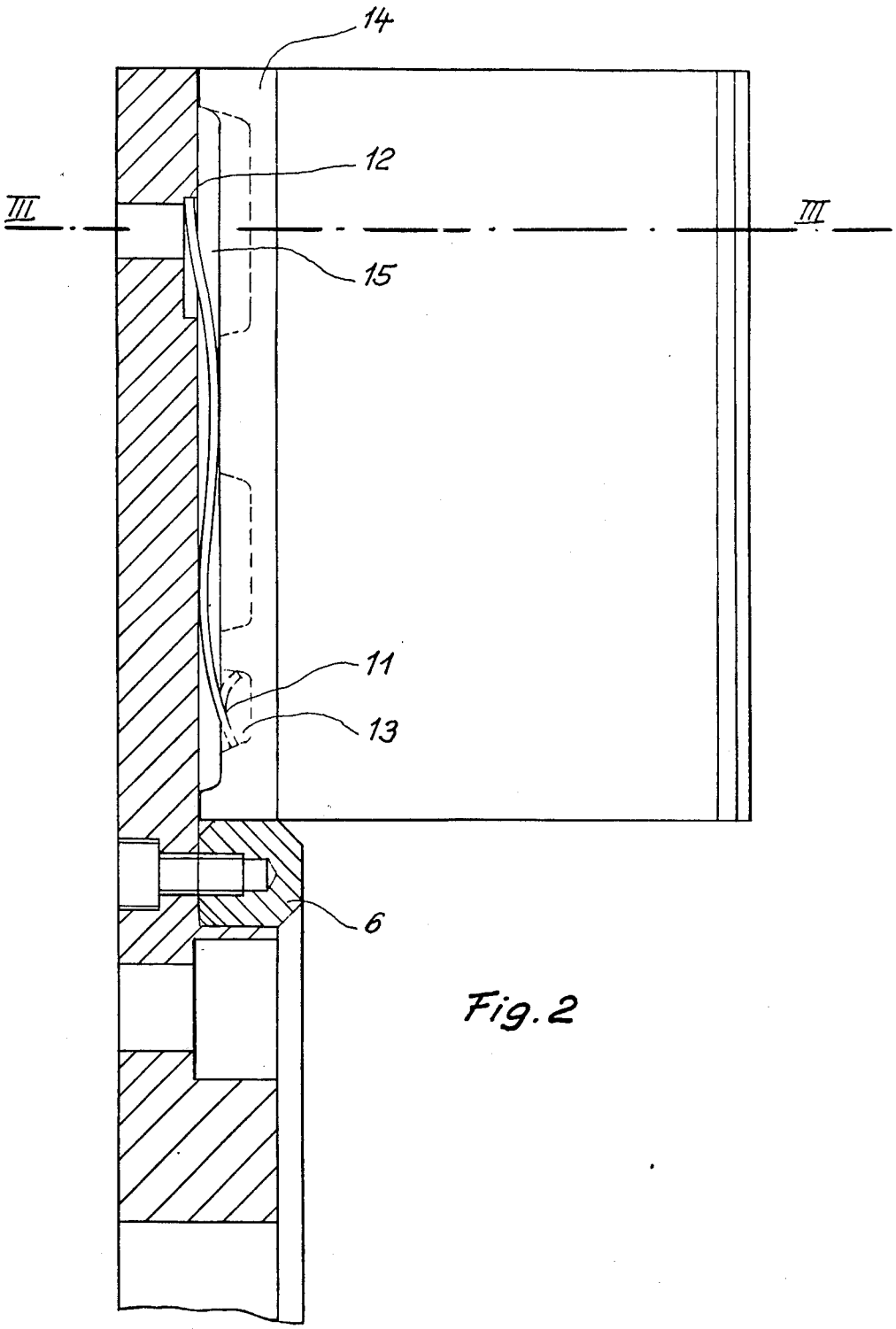
FIG. 2 is a view corresponding to FIG. 1 but wherein the projecting blade has been inserted into its final assembled position and locked in this position.
Figure 3:
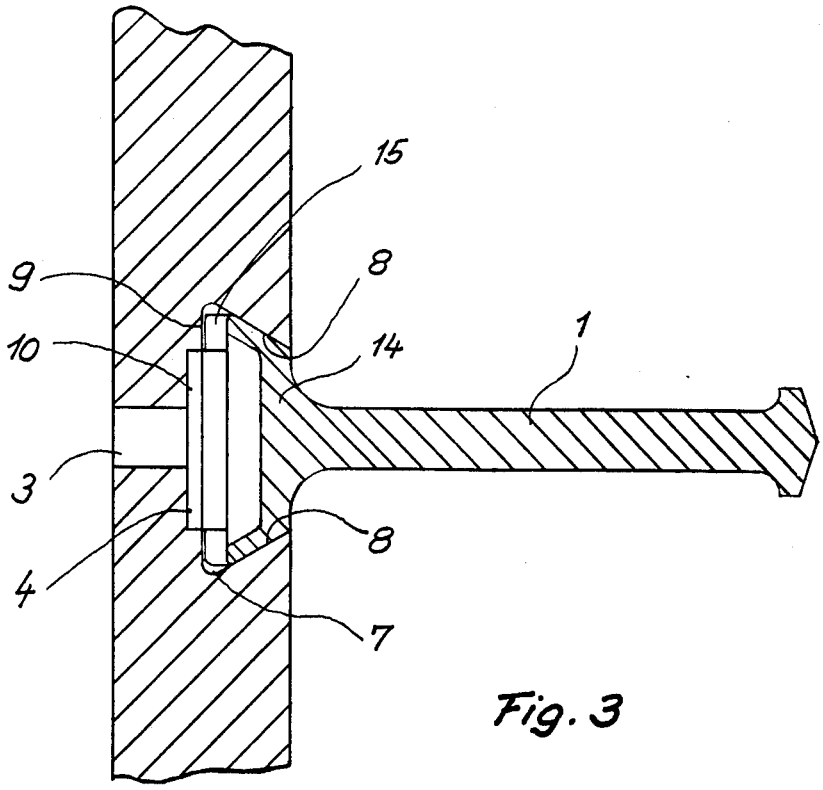
FIG. 3 is a cross-sectional view along the line III-III of FIG. 2.

When a projecting blade 1 has been inserted in radial direction inwardly toward the center of the centrifugal impeller wheel 2 into the position shown in FIG. 2, the radial outer end surface 12 of the spring 10 engages the outer edge 5 of the recess 4 and thus prevents any outward movement of the projecting blade 1, due to centrifugal forces.

The recess 4 communicates with an aperture 3 that extends in an axial direction through the centrifugal impeller wheel 2. By this aperture, a suitable tool such as a screw driver may be introduced into the recess 4, in order to urge the spring 10 into the recess 15 so that the spring end surface 12 disengages the edge 5 and the projecting blade 1 may be withdrawn outwardly in the radial direction.

Radially inwardly of the projecting blade 1 is provided an abutment ring member 6, and this ring member may be secured by screws (not shown).

As may be seen from the above description and as shown in the drawings, the spring 10 is of a very simple design and may easily be secured within the mounting recess 13 by simply inserting the bent hook portion of the spring into this recess. To secure and lock the projecting blade 1, it is merely required to slide the projecting blade 1 together with the spring 10 into the dovetailed groove 7. In the mounting position in which the radial inner edge of the projecting blade 1 engages the abutment ring member 6, locking of the projecting blade 1 is effected automatically by the spring 10 since the spring end surface 12 will automatically engage the edge 5 of the recess 4. In this position, the spring 10 is protected against blasting medium, and this in either direction of rotation of the centrifugal impeller, as may best be seen in FIG. 2. The projecting blade 1 may readily be released by inserting a suitable tool through the aperture 3 and disengaging the spring.

It is claimed:

1. A centrifugal impeller for sandblasting installations, comprising a rotatively driven centrifugal impeller wheel having a radially outwardly directed side surface, a plurality of radially oriented projecting blades mounted on said side surface of the impeller wheel by associated dovetail joints, and spring members operatively positioned between said side surface and said blades locking said blades in their mounted positions, said centrifugal impeller wheel and each projecting blade defining between them a recess in the region of each dovetail joint for accommodating a spring member in its operative position, each spring member being enclosed entirely in its recess between its associated projecting blade and the impeller wheel.

2. A centrifugal impeller for sandblasting installations, comprising a rotatively driven centrifugal impeller wheel, a plurality of radially oriented projecting blades mounted on one side surface of the impeller wheel by associated dovetail joints, and spring members locking said blades in their mounted positions, said centrifugal impeller wheel and each projecting blade defining between them a recess in the region of each dovetail joint for accommodating a spring member in its operative position so that each spring member is enclosed entirely between its associated projecting blade and the impeller wheel, each dovetail joint including a dovetail key on the projecting blade and a dovetailed groove in the centrifugal impeller wheel, and each associated recess extending lengthwise in the inner face of its dovetail key opposite the bottom wall of its dovetail groove and into the centrifugal impeller wheel to provide a recess edge facing radially inward so that upon sliding the spring member in a radial inward direction into the dovetailed groove the radially outer end surface of the spring member engages said edge of the recess in the centrifugal impeller wheel.

3. A centrifugal impeller according to claim 2, wherein said centrifugal impeller wheel includes for each projecting blade an aperture accessible from the side surface of the impeller wheel opposite a projecting blade, the aperture communicating with the region in which the associated spring member locks the projecting blade and engages an edge portion of the centrifugal impeller wheel.

4. A centrifugal impeller according to claim 3, wherein said aperture communicates with said recess at said edge which is engagable by said spring member.

* * * * *